US006845527B1

(12) United States Patent
Kohn

(10) Patent No.: US 6,845,527 B1
(45) Date of Patent: Jan. 25, 2005

(54) IN-THE-WALL PLUMBING TRAP WITH INTEGRAL WASTE AND VENT LINE

(76) Inventor: Guy Lindsay Kohn, 413 Sawmill River Rd., Millwood, NY (US) 10546

( * ) Notice: Subject to any disclaimer, the term of this patent is extended or adjusted under 35 U.S.C. 154(b) by 0 days.

(21) Appl. No.: 10/826,017

(22) Filed: Apr. 17, 2004

(51) Int. Cl.[7] ..... E03C 1/12

(52) U.S. Cl. ..... 4/679; 4/681; 137/247.41; 137/247.45

(58) Field of Search ..... 4/671–674, 679–681, 4/686, DIG. 13, DIG. 16; 137/247.35, 247.39, 247.41, 247.47

(56) References Cited

U.S. PATENT DOCUMENTS

| | | | | |
|---|---|---|---|---|
| 128,263 | A | | 6/1872 | Thompson |
| 178,059 | A | | 5/1876 | Hutchins |
| 292,055 | A | | 1/1884 | Riker |
| 316,962 | A | | 5/1885 | Harvey |
| 387,961 | A | | 8/1888 | Ryan |
| 497,465 | A | | 5/1893 | Burgoin |
| 514,675 | A | | 2/1894 | Farrell |
| 549,364 | A | | 11/1895 | Israel |
| 559,188 | A | | 4/1896 | Moore |
| 793,989 | A | | 7/1905 | Clark |
| 903,081 | A | | 11/1908 | Guthrie et al. |
| 933,279 | A | | 9/1909 | Welch |
| 954,558 | A | | 4/1910 | Young |
| 1,018,021 | A | | 2/1912 | Willetts |
| 1,102,136 | A | | 6/1914 | Calhoun |
| 1,183,568 | A | | 5/1916 | Keevan |
| 1,213,207 | A | | 1/1917 | Keller |
| 1,408,402 | A | | 2/1922 | Rogers |
| 2,015,469 | A | * | 9/1935 | Church ..... 137/247.45 |
| 2,303,037 | A | | 11/1942 | Fredrickson |
| 2,484,031 | A | | 10/1949 | Havrenius |
| 3,381,318 | A | | 5/1968 | Luijt |
| 3,487,478 | A | | 1/1970 | Harris |
| 3,651,826 | A | | 3/1972 | Kojima |
| 3,719,209 | A | | 3/1973 | Rush et al. |
| 3,766,575 | A | | 10/1973 | Grengs |
| 3,791,401 | A | | 2/1974 | Gorman |
| 3,860,978 | A | | 1/1975 | Wirth |
| 3,908,208 | A | | 9/1975 | McIlroy |
| 3,967,324 | A | | 7/1976 | Olive |
| 4,081,190 | A | | 3/1978 | Itzler |
| 4,185,654 | A | | 1/1980 | Young |
| 4,516,278 | A | | 5/1985 | Lamond |
| 4,597,404 | A | | 7/1986 | Van Marcke |
| 4,646,370 | A | | 3/1987 | Risberg et al. |
| D295,071 | S | | 4/1988 | Kohler et al. |
| 4,777,676 | A | | 10/1988 | Erricson |
| 4,811,753 | A | | 3/1989 | Bethune |
| 5,063,616 | A | | 11/1991 | Bresnahan |
| D332,654 | S | | 1/1993 | Reid et al. |
| 5,625,909 | A | | 5/1997 | Erricson |

FOREIGN PATENT DOCUMENTS

| | | |
|---|---|---|
| EP | 188.728 | 11/1985 |
| GB | 2.120.545 | 12/1983 |

OTHER PUBLICATIONS www.hawsco.com.

* cited by examiner

*Primary Examiner*—Tuan Nguyen
(74) *Attorney, Agent, or Firm*—Michael I Kroll

(57) ABSTRACT

An in-the-wall plumbing trap having integral connections for waste and vent lines wherein in the vent connection is located on the top of the trap housing and the waste connection on the bottom thereof. A substantially vertical wall formed by an overflow member separates the housing interior into two chambers with a liquid seal chamber located beneath a waste intake line and a separation chamber disposed on the other side of the overflow member. Effluent waste entering the liquid seal chamber builds up until reaching the top of the overflow member where it then spills over into the separation chamber and any gases contained therein rise to the top of the housing and escape through the vent line as the fluid flows to the bottom of the separation chamber and exits through the drain pipe.

11 Claims, 11 Drawing Sheets

IN-THE-WALL PLUMBING TRAP WITH INTEGRAL WASTE AND VENT LINE

BACKGROUND OF THE INVENTION

1. Field of the Invention

The present invention relates generally to plumbing and, more specifically, to a plumbing trap having waste and ventilation ports. The waste water will flow through the inlet port of the housing thereby increasing the volume of waste water within the liquid seal chamber then overflow at the topmost end of the overflow member within said housing exiting through the drainage pipe below. The existing constant volume of water contained within the liquid seal chamber prevents gases from returning therethrough, instead gases will escape through the ventilation pipe mounted to the coupling on the topmost end thereof.

In a conventional sanitary drainage system, a plumbing fixture is connected to a building sewer by a line having a generally U-shaped trap therein, a portion of the discharged waste liquid being retained in the bend of the trap to form a liquid seal that prevents sewer gas, vermin and objectionable odors from entering into the building proper through the fixture drain. Typically plumbing traps are protected against siphoning and back-pressure, and air circulation assured throughout all parts of the drainage system by means of connection to a vent pipe.

In the installation of plumbing fittings at the present time, it is customary prior to the closing in of the walls of a building, to place in position the main supply vent and waste pipes, complete with necessary elbows, fittings and the like, then cap or close these outlets, test the whole under pressure to ascertain the tightness of the joints, then leave everything until after completion of the wall enclosure, after which the plumbing fixture is attached in place. The stoppers removed and the various supply and waste connections are utilized in their intended manner. Common practice has the U-shaped trap exposed and placed directly under the plumbing fixture drain. A tailpiece connects the trap to the waste and vent piping inside of a wall. This facilitates servicing and cleaning by affording easy access to the trap for cleaning, should a blockage occur or if an object is accidentally dropped down the drain.

There is a need for a self-contained trap with integral waste and vent line connections, that is easy to install, not liable to clog, comparatively inexpensive, that can be used with all plumbing fixtures, and is hidden inside of a wall. The integral vent element allows the liquid seal to be not siphoned off, assuring that sewer gases cannot escape into the building through the plumbing fixture. The advantage of this invention over the old exposed U-shaped trap will result in a highly sanitary and aesthetic reduction of the amount of piping typically found under a plumbing fixture. In addition this invention will produce an overall reduction in the cost of construction for the installer over the traditional U-shaped trap installation method by virtue of its self contained design and the reduction of piping and ease and simplification of its connections to the building's waste and ventilation lines.

Another advantage of this new invention is that by employing it in conjunction with handicapped accessible or barrier free plumbing fixtures, it will allow for the raising the typical drain tailpipe height, thus producing the clearances necessary that a wheelchair bound person needs to freely access plumbing fixtures without encountering the obstacle that current U-shaped traps present. It will also eliminate the need for protective coverings often used to protect the underside of a handicapped accessible plumbing fixture or the piping itself.

This new invention also facilitates the introduction of new plumbing fixtures with narrower profiles, and provides greater open areas under the plumbing fixtures. By raising the drainage tail pipe, connected directly to the drain assembly, more clear space or storage area is created under the fixture. This is especially important when used with contemporary fixtures that exhibit a minimalist or clean profile.

The reduction and simplification of the piping by use of this invention, in place of the traditional U-shaped trap will also make this invention useful in locations such as hospitals, medical clinics and laboratories, where highly sanitary conditions require a minimum of surfaces that collect dust, dirt and germs.

It is a principal object that this invention be used with all plumbing fixtures to produce a reliable drainage system for a building and can be fabricated in a multitude of materials typical of plumbing fixture fabrication: Copper, Galvanized Steel, Black Steel, ABS, PVC, CPVC Plastics and Cast-Iron, etc.

Further this invention can be fabricated in different sizes with different size connection pieces to accommodate a variety of different plumbing fixtures and pipe sizes.

A further object is to provide a trap unit that is easily installed and simple to maintain.

2. Description of the Prior Art

There are other trap devices designed for plumbing. Typical of these is U.S. Pat. No. 128,263 issued to N. Thompson on Jun. 25, 1872.

Another patent was issued to E. F. Hutchins on May 30, 1876 as U.S. Pat. No. 178,059. Yet another U.S. Pat. No. 292,055 was issued to C. L. Riker on Jan. 15, 1884 and still yet another was issued on May 5, 1885 to Patric Harvey as U.S. Pat. No. 316,962.

Another patent was issued to W. B. Ryanon on Aug. 14, 1888 as U.S. Pat. No. 387,961. Yet another U.S. Pat. No. 497,465 was issued to E. L. Burgoin on May 16, 1893. Another was issued to J. Farrell on Feb. 13, 1894 as U.S. Pat. No. 514,675 and still yet another was issued on Nov. 5, 1895 to E. H Israel U.S. Pat. No. 549,364.

Another patent was issued to C. H. Moore on April 28, 1896 as U.S. Pat. No. 559,188. Yet another U.S. Pat. No. 793,989 was issued to T. H. Clark on Jul. 4, 1905. Another was issued to P. F. Guthrie on Nov. 3, 1908 as U.S. Pat. No. 903,081 and still yet another was issued on Sep. 7, 1909 to L. E. Welch as U.S. Pat. No. 933,279.

Another patent was issued to J. M. Young on Apr. 12, 1910 as U.S. Pat. No. 954,558. Yet another U.S. Pat. No. 1,018,021 was issued to William R. Willetts on Feb. 20, 1912. Another was issued to W. W. Calhoun on Jun. 30, 1914 as U.S. Pat. No. 1,102,136 and still yet another was issued on May 16, 1916 to R. H. Keevan as U.S. Pat. No. 1,183,568.

Another patent was issued to C. C. Keller on Jan. 23, 1917 as U.S. Pat. No. 1,213,207. Yet another U.S. Pat. No. 1,408,402 was issued to A. Rogers on Feb. 28, 1922. Another was issued to E. A. Fredrickson on Nov. 24, 1942 as U.S. Pat. No. 2,303,037 and still yet another was issued on Oct. 11, 1949 to H. Havvrenius as U.S. Pat. No. 2,484,031.

Another patent was issued to H. N. Luijt on May 7, 1968 as U.S. Pat. No. 2,484,031. Yet another U.S. Pat. No. 3,487,478 was issued to U. Harris on Jan. 6, 1970. Another was issued to Noriatsu Kojima on Mar. 28, 1972 as U.S. Pat. No. 3,651,826 and still yet another was issued on Mar. 6, 1973 to Clifford W. Rush as U.S. Pat. No. 3,719,209.

Another patent was issued to Norbert G. Grengs on Oct. 23, 1973 as U.S. Pat. No. 3,766,575. Yet another U.S. Pat. No. 3,791,401 was issued to John P. Gorman on Feb. 12, 1974. Another was issued to Paul H. Wirth on Jan. 21, 1975 as U.S. Pat. No. 3,860,978 and still yet another was issued on Sep. 30, 1975 to John C. McIlroy as U.S. Pat. No. 3,908,208.

Another patent was issued to Ernest Gene Olive on Jul. 6, 1976 as U.S. Pat. No. 3,967,324. Yet another U.S. Pat. No. 4,081,190 was issued to Daniel Itzler on Mar. 28, 1978. Another was issued to Lyle M. Young on Jan. 29, 1980 as U.S. Pat. No. 4,185,654 and still yet another was issued on Dec. 7, 1983 to George Molyneux as U.K. Patent No. GB 2,120,545 A.

Another patent was issued to Lee. T. Lamondas on May 14, 1985 as U.S. Pat. No. 4,516,278. Yet another U.S. Pat. No. 4,597,404 was issued to Karel C. Van Marcke on Jul. 1, 1986 Another was issued to Mark A. Risberg on Mar. 3, 1987 as U.S. Pat. No. 4,646,370 and still yet another was issued on Apr. 5, 1988 to Herbert V. Kohler et al as U.S. Pat. No. Des. 295,071.

Another patent was issued to Paul P. Bethune on Mar. 14, 1989 as U.S. Pat. No. 4,811,753. Yet another U.S. Pat. No. 5,063,616 was issued to Jeremiah J. Bresnahan on Nov. 12, 1991. Another was issued to Mary J. Reid et al on Jan. 19, 1993 as U.S. Pat. No. Des. 332,654 and still yet another was issued on May 6, 1997 to Kurt S. B. Ericson as U.S. Pat. No. 5,625,909.

U.S. Pat. No. 128,263

Inventor: Nathan Thompson

Issued: Jun. 25, 1872

A stench-trap composed of a series of curved or partly-curved pipe sections, made to fit the one within the other at their ends, and afterward soldered, forming joints transversely of the trap within the bent portion of it, substantially as specified.

U.S. Pat. No. 178,059

Inventor: Ed F. Hutchins

Issued: May 30, 1876

An S-shape stench-trap made detachable, and of elastic material, to allow the formation of the ice on the inside without fracture, and its ready removal without delay.

U.S. Pat. No. 292,055

Inventor: Carroll L. Riker

Issued: Jan. 15, 1884

The combination, substantially as hereinbefore described, with the basin, of the closed vessel situated beneath said basin, the pipe bent to form the trap, and extending from the bottom of the basin into and near to the bottom of the closed vessel, the discharge-pipe, extending from the top of the closed vessel and turning downward, the connecting-pipe, which extends from the highest point of the trap into the discharge-pipe, and the stop-cock fitted into the connecting-pipe.

U.S. Pat. No. 316,962

Inventor: Patrick Harvey

Issued: May 5, 1885

In combination with the bowl, the wastepipe leading therefrom and having a U-trap and opening within the valve-chamber, the valve-chamber having an eduction-port, the flexible diaphragm forming part of the wall of the valve-chamber, the valve secured on the inner surface of the diaphragm and adapted to seat over the open end of the waste-pipe, and an arm exterior to said chamber under adjustable pressure acting against said diaphragm and removable therefrom at will, substantially as set forth.

U.S. Pat. No. 387,961

Inventor: William B. Ryan

Issued: Aug. 14, 1888

In a plumber's trap, the combination, with the return vent-pipe, of a buoyant ball placed within a cage beneath the open mouth of the vent-pipe and adapted to close the same when the outlet-pipe becomes obstructed and the water rises within the trap, substantially as set forth.

U.S. Pat. No. 497,465

Inventor: Edward L. Burgoin

Issued: May 16, 1893

An overflow waste and trap having an inlet and an outlet and provided with two water seals and with a valve-controlled passage between such seals of less capacity than the inlet or outlet, and also provided with an air tight siphon passage arranged above such valve-controlled passage to communicate between the seals substantially as described.

U.S. Pat. No. 514,675

Inventor: John Farrell

Issued: Feb. 13, 1894

In a waste the combination with the standpipe, of a vertically movable overflow-pipe having a valve and fitting within the standpipe, and projections on the overflow-pipe adapted to clean the stand-pipe; substantially as and for the purposes described.

U.S. Pat. No. 549,364

Inventor: Earl H. Israel

Issued: Nov. 5, 1895

In a trap, the combination of an inverted cup located within the body of the trap, a tube extending into said cup, and a concave collar extending from the wall of the body of the trap to said tube, substantially as and for the purpose set forth.

U.S. Pat. No. 559,188

Inventor: Charles H. Moore

Issued: April 28, 1896

In a trap or fixture having a lower section, and an upper movable section curved in and over the discharge end of the trap, and adapted to be turned in either direction without moving the position of the water-retaining section of the said trap, a joint on the inlet side of the trap between the curved upper section and the lower retaining section, and a horizontal union-coupling to tighten the joint when the upper curved section is turned in any position, as and for the purpose set forth.

U.S. Pat. No. 793,989

Inventor: Thomas H. Clark

Issued: Jul. 4, 1905

In a ventilation system for liquid-seal traps, the combination with the liquid-seal trap, of the vent-pipe lending to the discharge end thereof, an air-inlet valve for the vent-pipe, and a flushing pipe connected to the vent-pipe.

U.S. Pat. No. 903,081

Inventor: Patrick F. Guthrie et al

Issued: Nov. 3, 1908

The combination with a receptacle and a sewer connection provided with a discharge valve, of a vertical outlet pipe for the receptacle, a horizontal pipe with which the vertical pipe communicates, said horizontal pipe discharging into the sewer connection above the valve, the outlet pipe being provided with a valve seat, and the horizontal pipe being extended beyond the outlet pipe to form a recess, a barrier in the horizontal pipe between the sewer connection and the outlet and curving toward said outlet, and a float valve in the horizontal pipe, said barrier acting to move the value into the recess when said valve moves downwardly, and on to the valve seat when said valve moves upwardly.

U.S. Pat. No. 933,279

Inventor: Lawrence E. Welch

Issued: Sep. 7, 1909

The combination with a, waste pipe having an enlarged receiving portion, and a trap having its discharge end projecting a suitable distance into the transverse center of said pipe whereby the discharge end is held free of the pipe and a space is formed entirely around the same, between said end and the wall of the waste pipe.

U.S. Pat. No. 954,558

Inventor: James M. Young

Issued: Apr. 12, 1910

A flushing and ventilating fitting comprising a tubular member having its upper end arranged for detachable connection to the outlet of the fixture to be flushed and provided with an internal circumferential enlargement connecting laterally with the passage through said tubular member entirely around the same and leading to a side ventilating outlet-connection integral with said tubular member.

U.S. Pat. No. 1,018,021

Inventor: William R. Willetts

Issued: Feb. 20, 1912

A waste comprising in combination a drawn sheet metal L member with interior threading and integral therewith, an annular rim flange, and a drawn sheet metal strainer member having a cup-shaped body portion provided with exterior threading and integral therewith an annular rim flange, said L member and said strainer member being adapted to be drawn toward each other by their threadings with the bottom of the object to which they are to be attached between their respective rim flanges and the fixture thus secured in place.

U.S. Pat. No. 1,102,136

Inventor: William W. Calhoun

Issued: Jun. 30, 1914

A plumbing fixture embodying a discharge pipe, a trap having one end connected to the discharge pipe, a removable closure attached to one end of the said pipe and having an elongated scoop projecting into and fitting against one wall of said pipe.

U.S. Pat. No. 1,183,568

Inventor: Raymond H. Keevan

Issued: May 16, 1916

The combination with a basin having an outlet nozzle, of means for automatically controlling the discharge of fluid from said basin, said means comprising an air confining chamber arranged to receive said outlet nozzle and communicating with the exterior atmosphere only by way of said nozzle, said chamber having a valveless drainage outlet near the bottom thereof, a waste pipe connected with said drainage outlet, said waste pipe being provided with a liquid seal, a sealing cup within said air chamber and arranged to receive the basin outlet nozzle, the wall of said sealing cup extending above the drainage outlet of the air chamber and having the rim thereof spaced from the top of said air chamber and manually operated means for draining said sealing cup.

U.S. Pat. No. 1,213,207

Inventor: Charles C. Keller

Issued: Jan. 23, 1917

In a lavatory, a cast metal member adapted to be secured to a wall between adjacent studs, pipe connections rigid with said member, upon the rearward side thereof, there being a chamber, in said member adapted to form part of a trap, a basin adapted to contact with and be secured to the face of said member, and having: a hollow portion adapted to form another part of a trap and means for securing said basin to said member, so as to support the same and complete said trap.

U.S. Pat. No. 1,408,402

Inventor: Alfred Rogers

Issued: Feb. 28, 1922

The combination with a wash basin and an associated waste pipe therefor which has a horizontal outlet potion, of a tubular housing of non-corrodible material enclosing and concealing said waste pipe from end to end, said housing being formed in separate sections with over lapped ends.

U.S. Pat. No. 2,303,037

Inventor: Edward A. Fredrickson

Issued: Nov. 24, 1942

In a pressure actuated valve of the character described, a casing having fluid inlet and outlet connections, an intermediate partition wall between said connections and having an opening therethrough, an elongated, tubular seat positioned within the said opening, a reciprocably movable closure member mounted tiltably thereon, the said closure member having a lower depending, inwardly extending skirt abutting upon and surrounding an upper annular portion of the said seat in the closed position of the valve whereby a huddling chamber is formed therebetween, the said casing having an opening to atmosphere, the outer periphery of the said lower depending skirt serving as a guide for the said closure member within the casing during the reciprocal movement of the latter member, the said closure member being engageable with said opening to atmosphere to form, a fluid seal upon actuation by line pressure.

U.S. Pat. No. 2,484,031

Inventor: Hilding. Havvrenius

Issued: Oct. 11, 1949

A trap for drain pipes and the like which comprises a hollow receptacle of generally tubular shape, an inlet socket member and an outlet socket member connected with said receptacle and an inner depending wall serving to partition the interior of said receptacle into a downwardly extending passageway and an upwardly extending passageways said passageways being in open communication at their lower ends to form a pocket adapted to hold a water seal and to form a continuous passageway connecting said inlet socket member with outlet socket member, said trap being adapted to be connected in the drain pipes of sinks and the like, said receptacle being constructed of an elastic plastic material which is sufficiently resilient to yield to deformation by the hand so that slime and other matter precipitated Inside said trap may be loosened therefrom by squeezing the receptacle by hand so as to temporarily deform the same.

U.S. Pat. No. 3,381,318

Inventor: Hermanus N. Luijt

Issued: May 7, 1968

A plumbing fitting comprising a chamber means adapted at its upper and lower ends for connection to a vertical waste stack through which waste material flows downwardly, said chamber providing for essentially uninterrupted flow between sections of waste stack, a waste inlet conduit communicating with the chamber, a vent means providing an air passage within the chamber from the point of entry of said waste inlet conduit and through said chamber wall to a point outside and apart from the chamber and waste stack, the vent means entry to the chamber being horizontally removed from said waste entry, said vent means providing an air passage within said chamber even when sewage is passing through the chamber.

U.S. Pat. No. 3,487,478

Inventor: Ulysses Harris

Issued: Jan. 6, 1970

In combination with a water basin fastened to an adjacent wall, said basin having one or more downwardly protruding drain and/or access pipes fastened to said wall, the improvement comprising: a cover in the form of a synthetic plastic shell adapted to be preformed by mass production techniques, said cover comprising an outwardly; bulging cavity shaped to accommodate and conceal from view said downwardly protruding pipes by substantially closing the space between the underside of said basin and a level above floor level but below said pipes, said cavity shaped so that its peripheral edges at least partly define a first opening constructed to surround and fit closely beneath said basin, and a second opening connected to said first opening and in a plane substantially normal to the principal plane of said first opening, the edges of said second opening constructed to fit flush against said wall surrounding said pipes on the underside of said basin, and means attached to the edges of said second opening for fastening said cavity to said wall.

U.S. Pat. No. 3,651,826

Inventor: Noriatsu Kojima

Issued: Mar. 28, 1972

A floor drain trap for use with a horizontal drain pipe is formed of a housing with a laterally extending connection having an outlet for attachment to the horizontal drain pipe. Extending downwardly into the housing from its upper end and spaced inwardly from its inner surface, is a frustoconically shaped inlet drain pipe section which has its lower end spaced above the bottom of the housing. The housing has an opening communicating with the drain pipe connection and the lower edge of the opening is spaced above both the lower end of the inlet drain pipe section and the invert of the outlet to which the horizontal drain pipe is connected. Flow passes downwardly into the trap through the drain pipe section then upwardly about the outer surface of the inlet drain pipe section and over the lower edge of the opening in the housing into the connection to the horizontal drain pipe.

U.S. Pat. No. 3,719,209

Inventor: Clifford W. Rush et al.

Issued: Mar. 6, 1973

An improved method is disclosed for fabricating a rigid plastic tubular article having an integral arcuate portion along its tubular axis. Articles such as plumbing traps, waste bends, etc., manufactured by the method are also disclosed.

U.S. Pat. No. 3,766,575

Inventor: Norbert G. Grengs

Issued: Oct. 23, 1973

A vented drain for recreational vehicles and the like which provides the required venting of sink drains without generally requiring more than one hole through the vehicle wall. The vented drain is substantially a one-piece molded plastic member which connects to the sink drain tine within the vehicle and conducts drain fluid through to: vehicle wall by a first conduit. A second conduit, either surrounding the first conduit or adjacent thereto, provides a flow path for vent air through the vehicle wall and communicates with a vertically disposed baffle stack within the vehicle to define a flow path for vent air of the required height. This prevents drain fluid flow through the vent and provides a source of vent air to the drain conduit to prevent siphoning of the drain trap. Various embodiments of the basic invention are disclosed.

U.S. Pat. No. 3,791,401

Inventor: John P. Gorman

Issued: Feb. 12, 1974

A trap unit for installation into a sanitary drainage system, including a generally U-shaped trap body having a vent element molded on the inlet leg. The vent element has a chick valve to prevent overflows, and the: trap unit functions to prevent self siphonage of its liquid seal.

U.S. Pat. No. 3,860,978

Inventor: Paul H. Wirth

Issued: Jan. 21, 1975

A novel trap for easy installation in a plumbing system, and being fitted between a drain fitting of a plumbing fixture and a sewer line; the device consisting of a flexible hose made of a suitable material and which has a wall configurated into adjacent transverse accordion pleats so that the hose can be longitudinally flexed into bends without deformation and constricting the passage therethrough, fittings at opposite ends of the how for connections, and a removable separate clamp for maintaining the hose in a U-shape so to form a trap.

U.S. Pat. No. 3,908,208

Inventor: John C. McIlroy

Issued: Sep. 30, 1975

The plumbing line trap provided is fabricated from a deflectable type of plastic material and is easily cleaned once removed and placed in the cleaning position. Removal is facilitated by the construction of the two free ends of the return bend of the trap each of which includes a collar for retaining in place a resilient clump which is loosened or tightened through the operation of an associated threaded fastener. The ma-material from which the return bend is fabricated is preferably a high density polyethylene of a clear or transparent type which admits light and thus permits the home owner to readily determined whether or not cleaning is necessary or impending.

U.S. Pat. No. 3,967,324

Inventor: Ernest Gene Olive

Issued: Jul. 6, 1976

A flexible trap for a waste line assembly of a toilet includes a U-shaped portion having a pair of upwardly extending legs and a lower section having a threaded hole therethrough. A threaded plug threadably engages the threaded hole. A linear portion having a flexible corrugated section therein is affixed perpendicularly in a fluid serial connection to an upper end of a leg of the U-shaped portion. The U-shaped portion and the linear portion have a continuous bore therethrough.

U.S. Pat. No. 4,081,190

Inventor: Daniel Itzler

Issued: Mar. 28, 1978

A process and device for connecting a sink tailpiece to a trap out of alignment therewith. The device has an upper section, a lower rigid section capable of being cut with a hacksaw, and a flexible pleated section.

U.S. Pat. No. 4,185,654

Inventor: Lyle M. Young

Issued: Jan. 29, 1980

The anti-siphoning device includes a T-shaped valve body having a downwardly facing opening, an upwardly facing opening and a laterally facing opening. Constrained for vertical movement within the valve body is a hollow cylindrical float valve having a closed lower end for normally closing the lower opening of the valve body, an open upper end so that air can pass downwardly through the upwardly facing opening of the valve body into the interior of the cylindrical float valve, out through the circumferentially spaced holes and then through the laterally facing opening of the valve body. The downwardly facing opening of the valve body is connected to the outlet of the sink or basin to be drained. Waste water entering the valve body via the downwardly facing opening buoys the float valve upwardly, the water passing outwardly through the laterally facing opening along with the air entering the upwardly facing opening of the valve body. When no waste water is flowing, then the weight of the float valve seals against an annular seat innerjacent the downwardly facing opening of the valve body so that sewer gases will not flow upwardly past the float valve. Also, an air valve is located in the upper portion of the valve body, the air valve normally preventing air from entering the valve body but permitting air to enter when a reduced pressure exists within the valve body due to the flow of waste water upwardly through the downwardly facing opening and outwardly through the laterally facing opening.

U.S. Pat. No. 4,516,278

Inventor: Lee. T. Lamond

Issued: May 14, 1985

A plumbing trap is described for use with drain pipes from sinks or other fixtures that fits pipe of different diameters, which drain pipes need not be in perfect alignment, and may be of a different diameter at the entrance than at the exit of the trap. The trap can be easily attached and detached, is molded of a flexible plastic which provides a soft structure that can be manually manipulated to discharge obstruction therefrom without removal from the drain pipes, and is impervious to most chemicals.

U.S. Pat. No. 4,597,404

Inventor: Karel C. Van Marcke

Issued: Jul. 1, 1986

An integrated plumbing fixture for drains and having a P-trap includes a vent downstream of the P-trap and a plurality of horizontally and vertically oriented outlets upstream and downstream of the P-trap, one of which outlets may be selected to accommodate various on-site constraints and requirements.

U.S. Pat. No. 4,646,370

Inventor: Mark A. Risberg et al.

Issued: Mar. 3, 1987

A shroud apparatus which mounts under a wall-mounted lavatory to enclose the trap of a lavatory is disclosed. The shroud has upper and lower rearward attachment regions which are hidden by the walls of the shroud when the shroud is viewed from the front. The shroud defines a hollow interior portion which is upwardly open to receive the trap. It also includes a shroud fastening element in its upper rearward attachment region and a securing element that cooperates with said shroud fastening element so as to restrict the forward movement of the shroud. A connector is attachable to the bathroom wall and to the lower rearward attachment region of the shroud.

U.S. Pat. No. Des. 295,071

Inventor: Herbert V. Kohler et al

Issued: Apr. 5, 1988

The ornamental design for a combined lavatory and pipe, as shown and described.

U.S. Pat. No. 4,777,676

Inventor: Kurt S. B. Ericson

Issued: Oct. 18, 1988

A sanitary appliance comprising a main basin (11) and an adjacent chamber (1) separated from said basin by a wall (3), said main basin being provided with an outlet (2) communicating with said chamber, said chamber being also provided with an outlet (5), the appliance further comprising an opening and closing device (7) mounted in the chamber and operated from outside the chamber, said device comprising an upstanding pipe movable between a closing position wherein it prevents liquid to flow from the outlet of the main basin directly to the outlet of the chamber, and an open position, wherein it permits such liquid flow; at least a part of the wall (3) separating the chamber and the main basin being removable.

U.S. Pat. No. 4,811,753

Inventor: Paul P. Bethune

Issued: Mar. 14, 1989

A drain vent apparatus for recreational vehicles may be coupled to the drain vent of a drain line of a vehicle and includes a coupling for a drain hose for the output of the drain vent. The drain vent has an outer housing and an inner pipe located in said outer housing and connected to the coupling for the drain vent for coupling to a drain line of a vehicle. The outer housing forms an annular passageway around the inner pipe for the passage of air and a check valve is located in the outer housing passageway to allow the passage of air in one direction while blocking the passage of water in the opposite direction so that the outside vent air may pass into the drain vent to vent the drain line. The outer housing has an opening to atmosphere covered by a cap. The check valve may be mounted adjacent to the opening in the passageway adjacent the cap so that removal of the cap allows access to the check valve. The smaller inner pipe forms a venturi with the outer housing at the opening of the passageway and inner pipe to the drain hose so that air is aspirated into the drain vent.

U.S. Pat. No. 5,063,616

Inventor: Jeremiah J. Bresnahan

Issued: Nov. 12, 1991

A drainage trap with a trap portion is described for use with drain pipes from sinks or other fixtures that fits pipe of different diameters, the drain pipes need not be in perfect alignment. The drainage trap can be easily attached and detached at its upper end to a drain outlet and at its lower end to a discharge pipe, is molded of a self-supporting, flexible material which allows the drainage trap to be manually manipulated. The drainage trap has an S-shaped configuration which enables the trap portion to be movable in a vertical direction towards the drain outlet and a horizontal direction towards the discharge pipe for the purpose of draining the trap portion.

U.S. Pat. No. Des. 332,654

Inventor: Mary J. Reid et al

Issued: Jan. 19, 1993

The ornamental design for a shroud for a lavatory, as shown and described.

U.S. Pat. No. 5,625,909

Inventor: Kurt S. B. Erricson

Issued: May 6, 1997

Sanitary appliance (washbasin, bidet, bath, sink, etc . . . ) which comprises a main basin (2) in conjunction with an adjoining chamber (4), but where the basin (2) an the chamber (4) are separated from one another by an at least partially removable wall (3). The water in the basin (2) is in contact with chamber (4) via openings (14). The chamber (4) is provided with a discharge conduit which at the same time forms the overflow (15). Said discharge conduit is a virtually upright pipe (7, 8) which in the open state discharges the water and in the closed state retains the water in the basin. At least a portion of the removable wall (3) is joined to at least a portion of the upright pipe.

While these plumbing traps may be suitable for the purposes for which they were designed, they would not be as suitable for the purposes of the present invention, as hereinafter described.

SUMMARY OF THE PRESENT INVENTION

Prior Art B Dallmer Concealed Wash Basin Trap

This concealed trap has a housing with a rectangular cross section. A connection piece extends from the upper front wall of the housing. A flexible hose that forms a tight seal is inserted into this connection piece. Sealing flanges on the hose prevents water from leaking out around the sides of the connection piece. A sink drainpipe is inserted into this flexible hose. A waste pipe connection extends from the bottom on a perpendicular axis. The interior of the housing is divided into three channels situated next to each other. The first channel is formed by a flexible hose that starts from the connection piece that lies flat against the sidewall of the housing and extends into the lower part of the second chamber (fluid seal chamber). From there the water flows upwards through a second channel between the hose and the separation walls. When water reaches the top of the overflow member it flows over the edge and down into the third channel to the waste pipe outlet. To clean the trap, the flexible hose insert is removed. This allows cleaning through the extending frontal connection piece.

Invention Description

This concealed In-The-Wall trap is a self-contained unit. It's housing is a rectangular cross section. A connection piece extends from the upper front wall of the housing. A flexible hose that forms a tight seal is inserted into this connection piece. Sealing flanges on the hose prevent water from leaking out around the sides of the connection piece. A sink drainpipe is inserted into this flexible hose. A waste pipe connection extends from the bottom on a perpendicular axis. The interior of the housing is divided into three channels situated next to each other. The first channel is formed by a flexible hose that starts from the connection piece that lies flat against the sidewall of the housing and extends into the lower part of the second chamber (fluid seal chamber). From there the water flows upwards through a second channel between the hose and the separation wall. When the water reaches the top of the overflow member it flows over the edge and down into the third channel to the waste pipe outlet. A top connection piece allows for a vent pipe to connect directly to the trap housing itself, preventing back pressure and siphoning and allowing the water to flow smoothly down the bottom outlet. To clean the trap, when concealed in the wall, the frontal connection piece protrudes slightly beyond the wall surface. An escutcheon piece serves to cover the frontal connection piece and drain tail pipe connection into the flexible hose. Once the escutcheon is pushed away from the wall, the drain tailpipe is slid out. This allows the flexible hose insert to be removed allowing access through the extending frontal connection piece to clean the interior reservoir.

In the current Dallmer trap, the effluent's velocity is retarded by mixing with the airflow together down the waste outlet connection. This could also cause the problem of loss of the liquid seal by self-siphoning when a volume of waste water is discharged. This action also could create a loud noise in the pipe by strangling the air supply to the waste drain. Additionally when two or more of these traps are installed in series on the same vent line, the problem of self-siphoning is magnified. By adding the top vent connection piece to this new In-The-Wall trap, it improves the existing Dallmer trap by providing a completely separate air passageway at the top connection of the trap. By thus venting the trap unit so that the air and effluent do not mix, the liquid seal is not siphoned off, and assurance is obtained that sewer gases cannot escape into the building through the plumbing fixture. Further, this improvement allows the installation of two or more traps onto the same vent line without the problem of back pressure, self-siphoning or loud noises.

A primary object of the present invention is to provide a plumbing fitting having a trap with a waste port and vent port forming an integral part therewith.

Another object of the present invention is to provide a plumbing trap having a vent port therein.

Another object of the present invention is to provide a plumbing trap having a waste port.

Yet another object of the present invention is to provide housing having a plurality of apertures.

Still yet another object of the present invention is to provide housing having a plurality of couplings thereon.

Another object of the present invention is to provide a safer environment for the home or business.

Yet another object of the present invention is to provide a new and novel plumbing component.

Additional objects of the present invention will appear as the description proceeds.

The present invention overcomes the shortcomings of the prior art by providing a plumbing trap having waste and ventilation ports. The waste water will flow through the inlet port of the housing increasing the volume of waste water within the separation chamber before overflowing at the topmost end of the overflow member exiting through the drainage pipe below. The existing constant volume of water contained within the liquid seal chamber prevents gases from returning therethrough, instead gases will escape through the ventilation pipe mounted to the coupling on the topmost end thereof.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
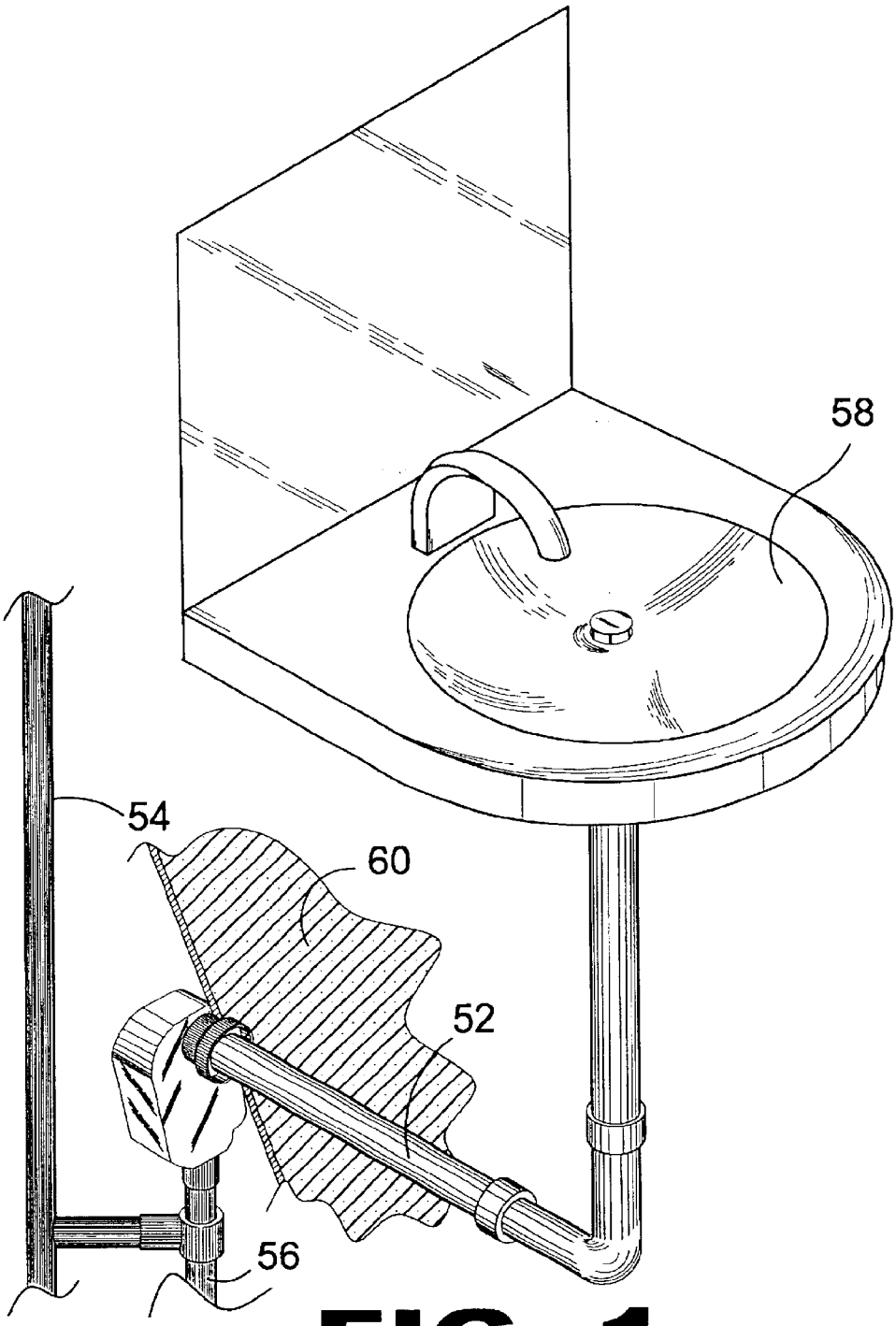
FIG. 1 is an illustrative view of prior art.

Turning now descriptively to the drawings, in which similar reference characters denote similar elements throughout the several views, the figures illustrate the In-the Wall Plumbing Trap with Integral Waste and Vent Line of the present invention. With regard to the reference numerals used, the following numbering is used throughout the various drawing figures.

10 In-the Wall Plumbing Trap with Integral Waste and Vent Line

12 trap housing

14 top plate of 12

16 bottom plate of 12

18 front plate of 12

20 rear plate of 12

22 first sidewall of 12

21 second sidewall of 12

24 interior of 12

26 overflow member

28 vent pipe coupling

30 waste line coupling

32 wall flange assembly

34 body of 32

36 finishing flange of 32

38 flexible insert

40 sealing head of 38

42 sealing face of 38

44 sealing flange of 38

46 discharge tube of 38

47 central cavity of 38

48 liquid seal chamber

50 separation chamber

52 drain pipe

54 vent pipe

56 waste line

58 sink

60 wall

62 in-the-wall plumbing trap of the prior at

64 waste water

66 catch basin of 38

68 escutcheon

70 female notch

72 male key

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 62. Shown is a prior art in-the-wall 60 plumbing trap 62 mounted below a wash sink 58 having a drainpipe 52 connected to an inlet port of the trap 62 and connected to a waste pipe 56, with the waste pipe 56 having a common vent pipe 54 connection.

Figure 2:
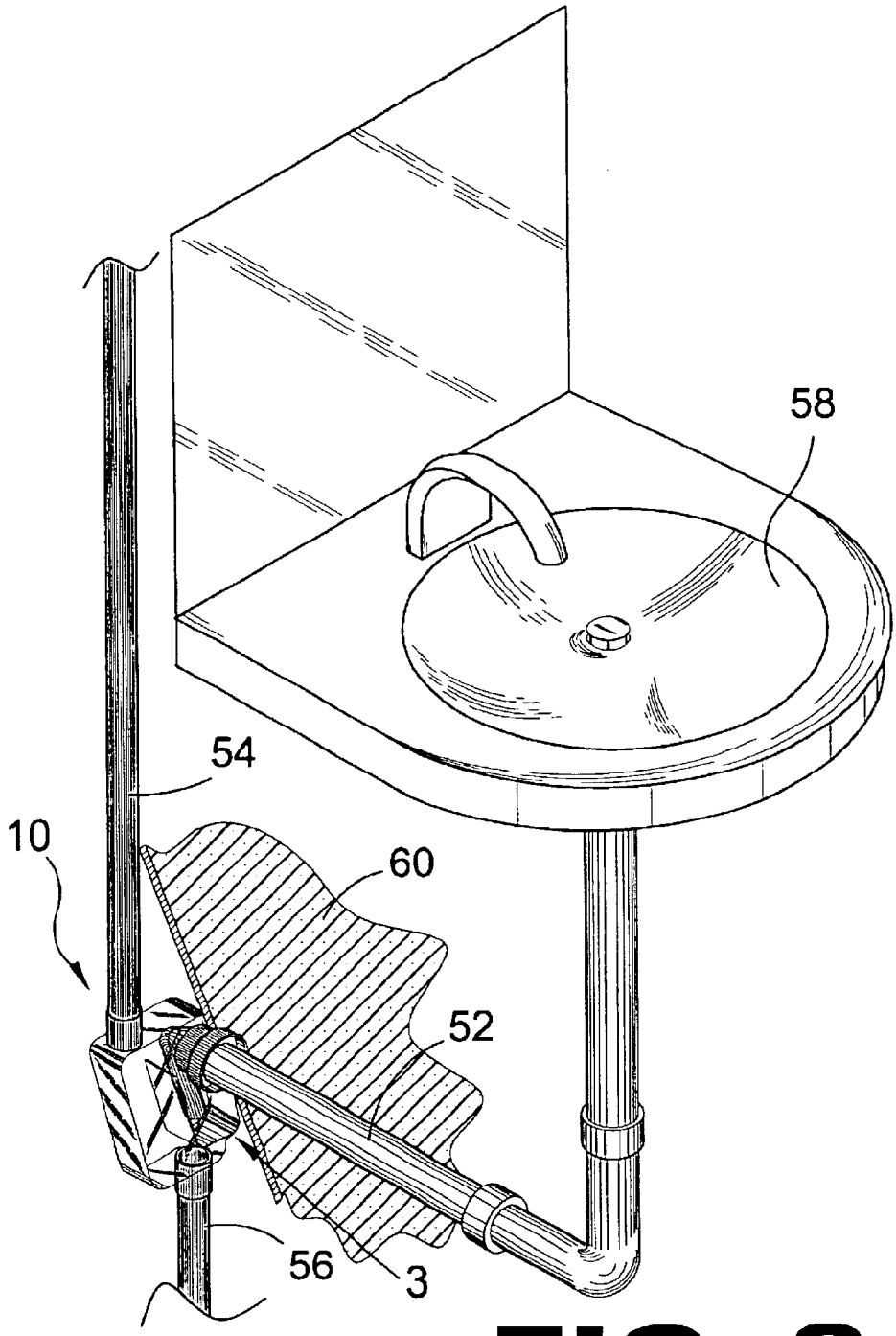
FIG. 2 is an illustrative view of the present invention.

FIG. 2 is an illustrative view of the present invention 10. Shown is the present invention, an in-the-wall plumbing trap 10 mounted below a wash sink 58 having a drain pipe 52 connected to an inlet port of the trap 10 with the top most end of the housing having a ventilation pipe 54 connected thereto.

Figure 3:
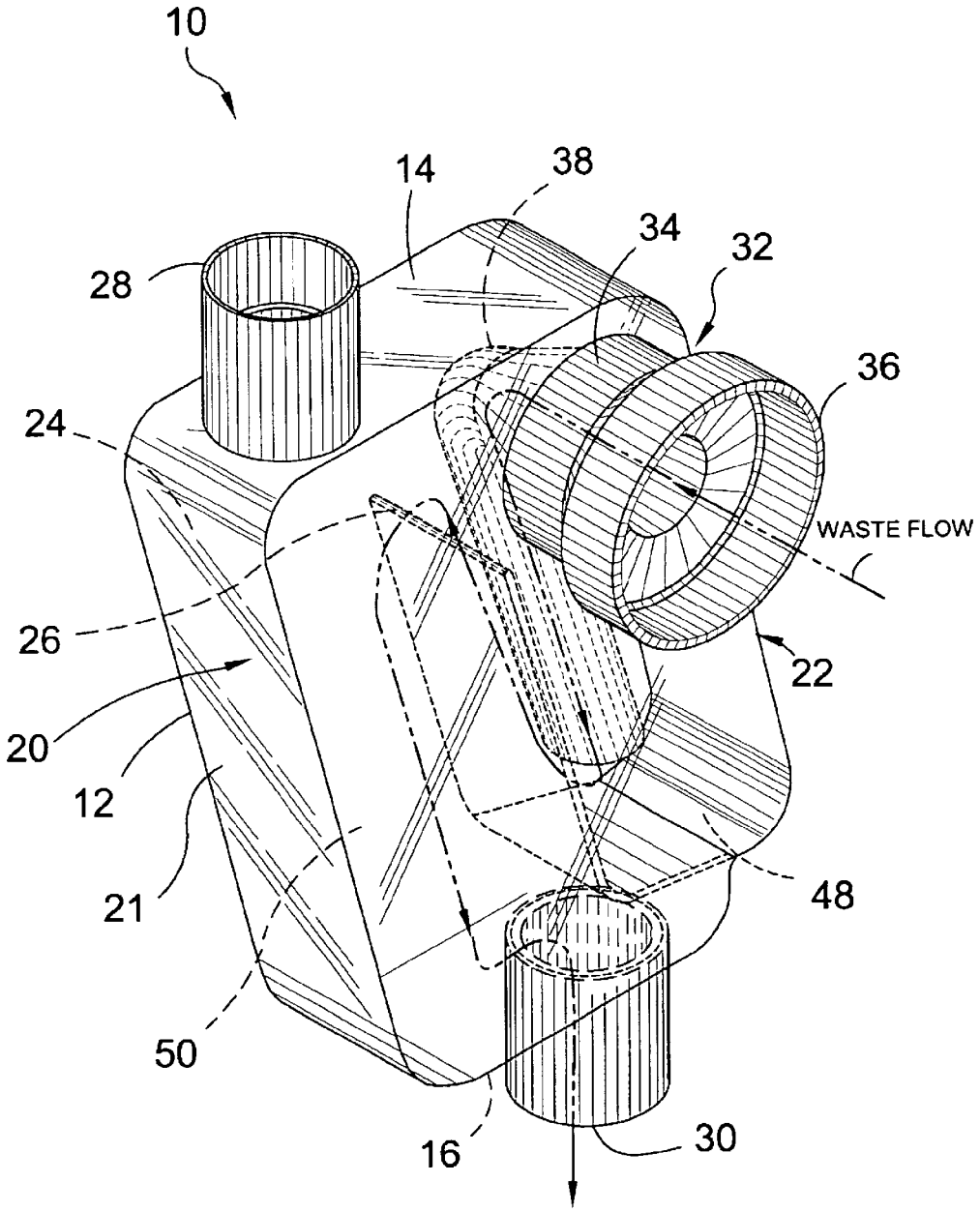
FIG. 3 is a perspective view of the present invention.

FIG. 3 is a perspective view of the present invention 10. Shown is the present invention, an in-the-wall plumbing trap comprising a housing 12 having a top plate 14, a bottom plate 16, a front plate 18, a rear plate 20, a first sidewall 21, a second sidewall 22, an interior 24 and an overflow member 26. A vent coupling 28 is disposed on the top plate 14 which has a corresponding recess therein and also serves as a port. A waste line coupling 30 is disposed on the bottom plate 16 which also has a corresponding recess and serves as a port. The overflow member 26 effectively divides the housing interior 24 into two distinct chambers—a liquid seal chamber 48 and a separation chamber 50.

Figure 4:
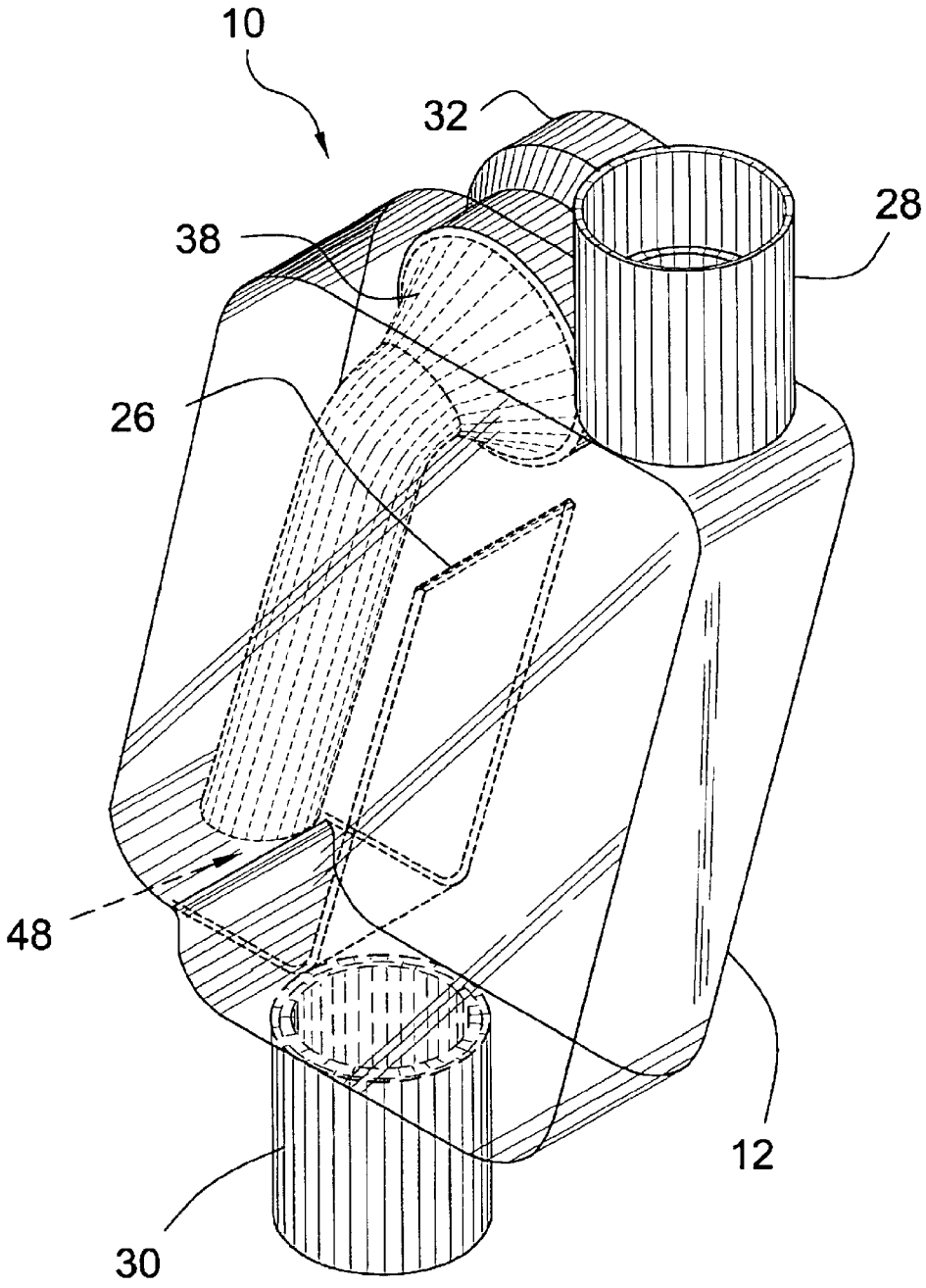
FIG. 4 is a back perspective view of the present invention.

FIG. 4 is a rear perspective view of the present invention 10. Shown is the present invention 10, an in-the-wall plumbing trap 10 comprising a housing 12 having a plurality of connection means 28,30,32 for a drain 52, waste line 56 and vent pipe 54.

Figure 5:
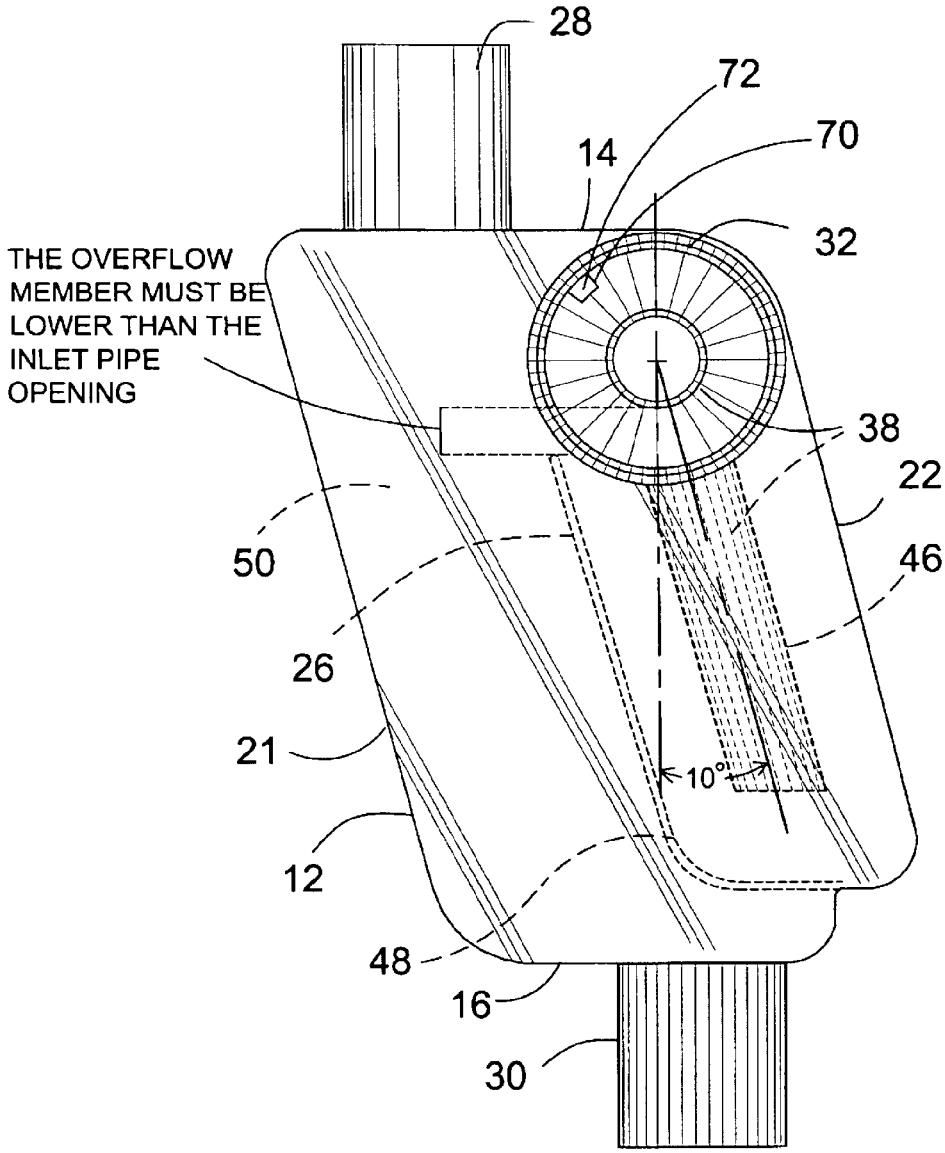
FIG. 5 is a front view of the present invention.

FIG. 5 is a front view of the present invention 10. Shown is the present invention 10, an in-the-wall plumbing trap 10 comprising a housing 12 having an interior with an over flow member 26 dividing it into a liquid seal chamber 48 and a separation chamber 50. The bottom plate 16 is offset from the top plate 14 thereby giving the sidewalls 21,22 a 10 degree pitch. The vertical portion of the overflow member 26 and the discharge tube 46 of the flexible insert 38 are parallel with said sidewalls 21,22. Additionally shown is the female notch 70 engaging the male key 72 to hold the flexible insert 38 in place.

Figure 6:
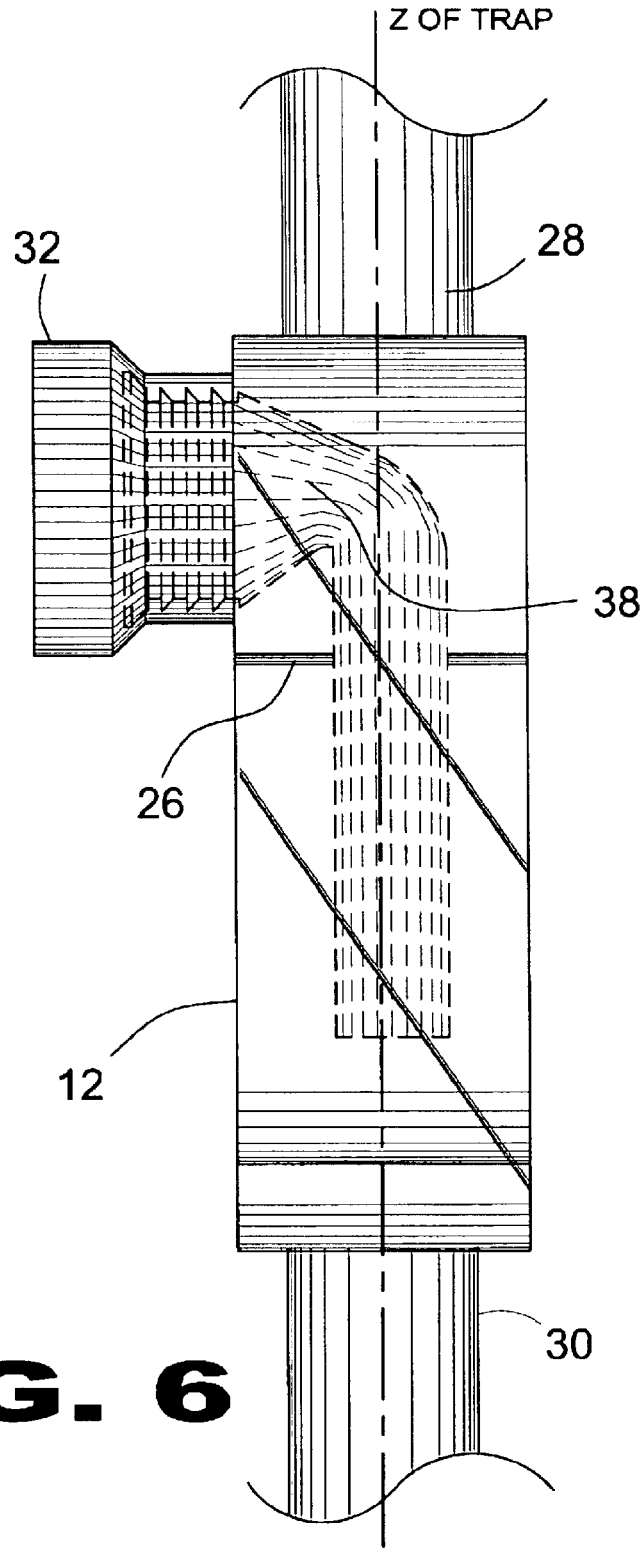
FIG. 6 is a side view of the present invention.

FIG. 6 is a side view of the present invention 10. Shown is the present invention 10, an in-the-wall plumbing trap 10 comprising a housing 12 having a vent pipe coupling 28, a waste line coupling 30, a wall flange assembly 32, a flexible insert 38 and an overflow member 26.

Figure 7:
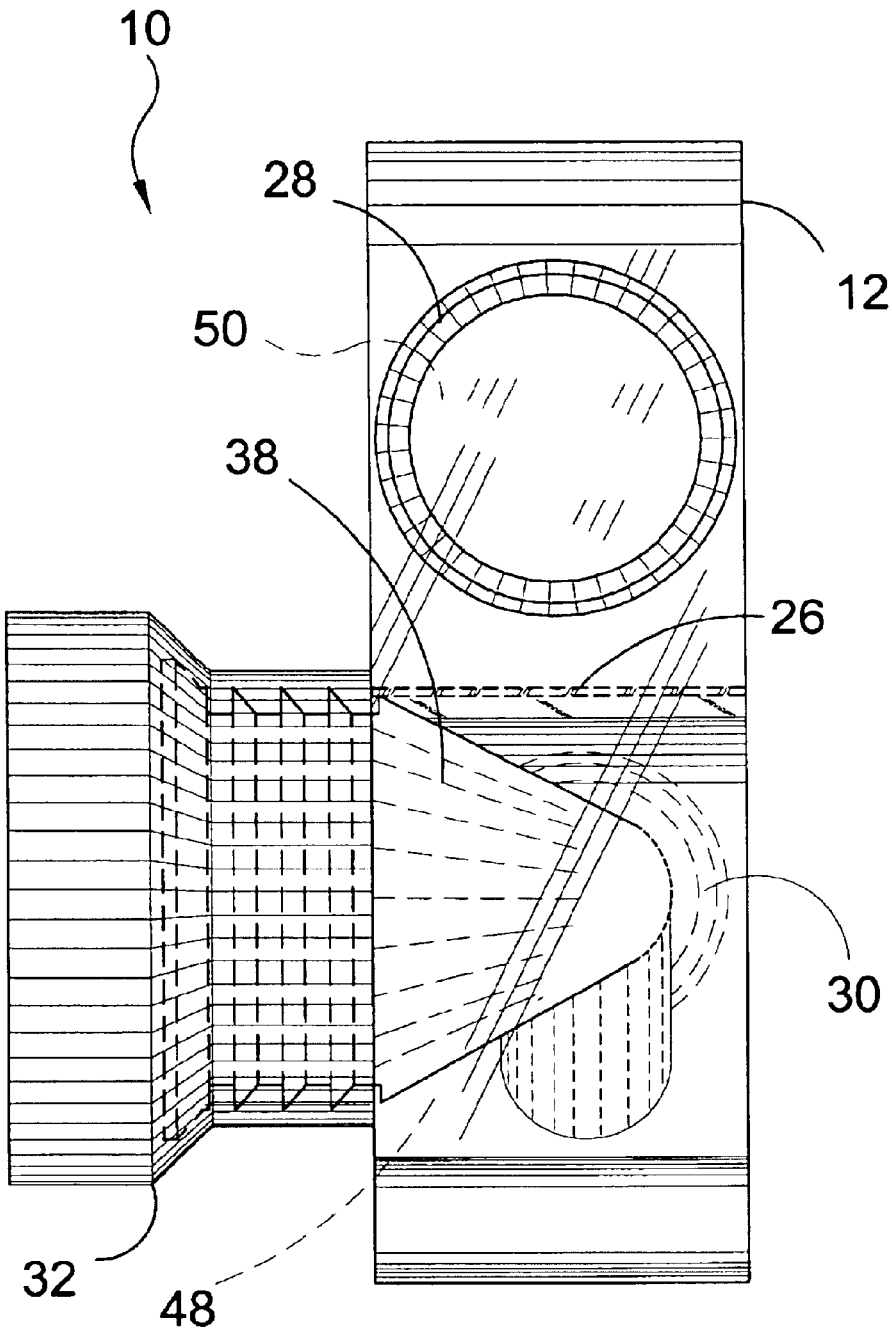
FIG. 7 is a top view of the present invention.

FIG. 7 is a top view of the present invention 10. Shown is the in-the-wall plumbing trap 10 comprising a housing 12 having a vent pipe coupling 28, a waste line coupling 30, a wall flange assembly 32, a flexible insert 38 and an overflow member 26 defining the liquid seal chamber 48 and the separation chamber 50.

Figure 8:
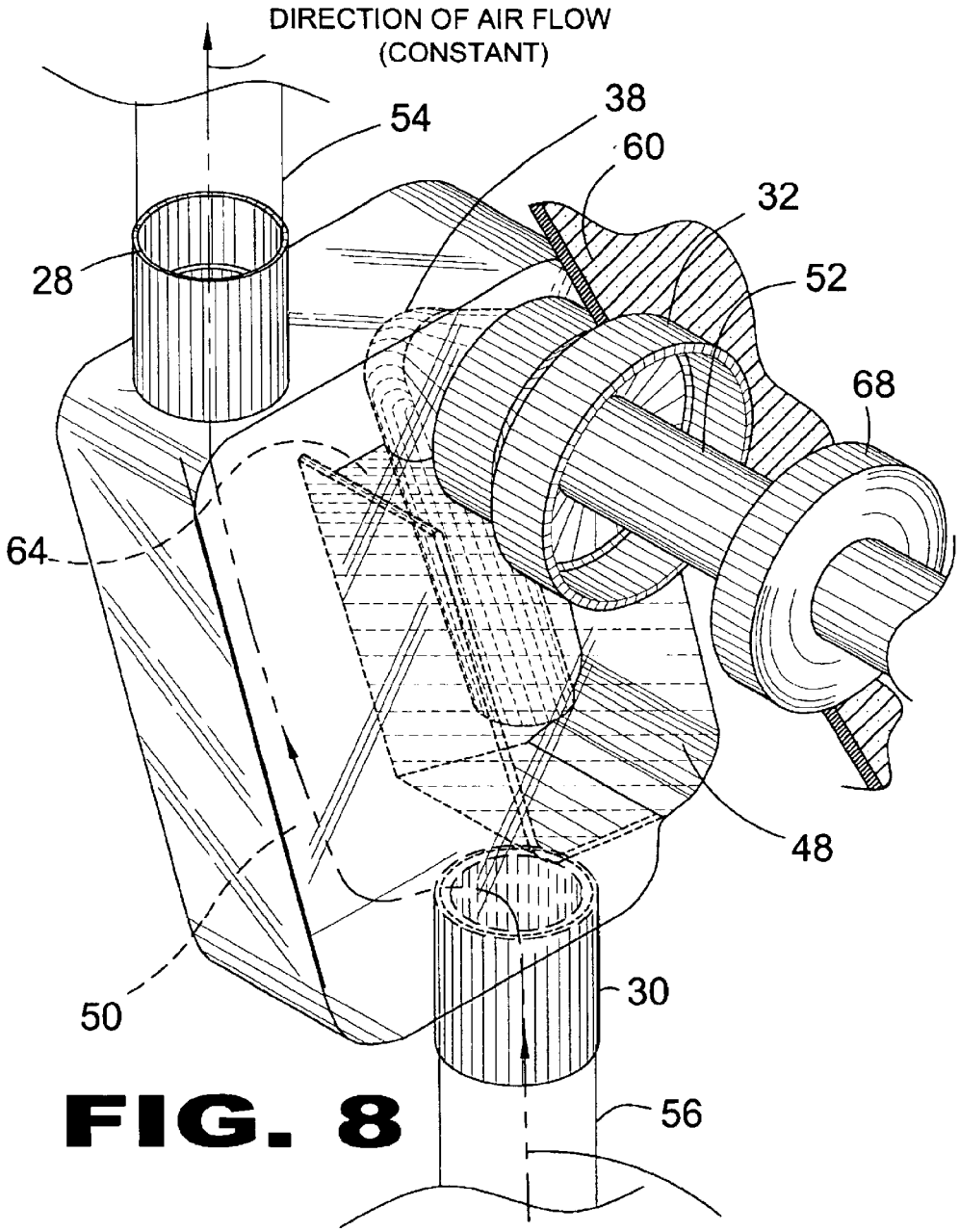
FIG. 8 is an illustrative view of the present invention.

FIG. 8 is an illustrative view of the present invention 10. Shown is the in-the-wall plumbing trap 10 having waste water 64 within the liquid seal chamber 48. The existence of waste water 64 volume within the liquid seal chamber 48 prevents gas from returning therethrough. Also shown is a drain pipe 52 connected thereto and said trap having a waste port 30 and vent port 28 forming an integral part therewith. Also shown is escutcheon 68 on drainpipe 52 used to cover wall flange assembly 32.

Figure 9:
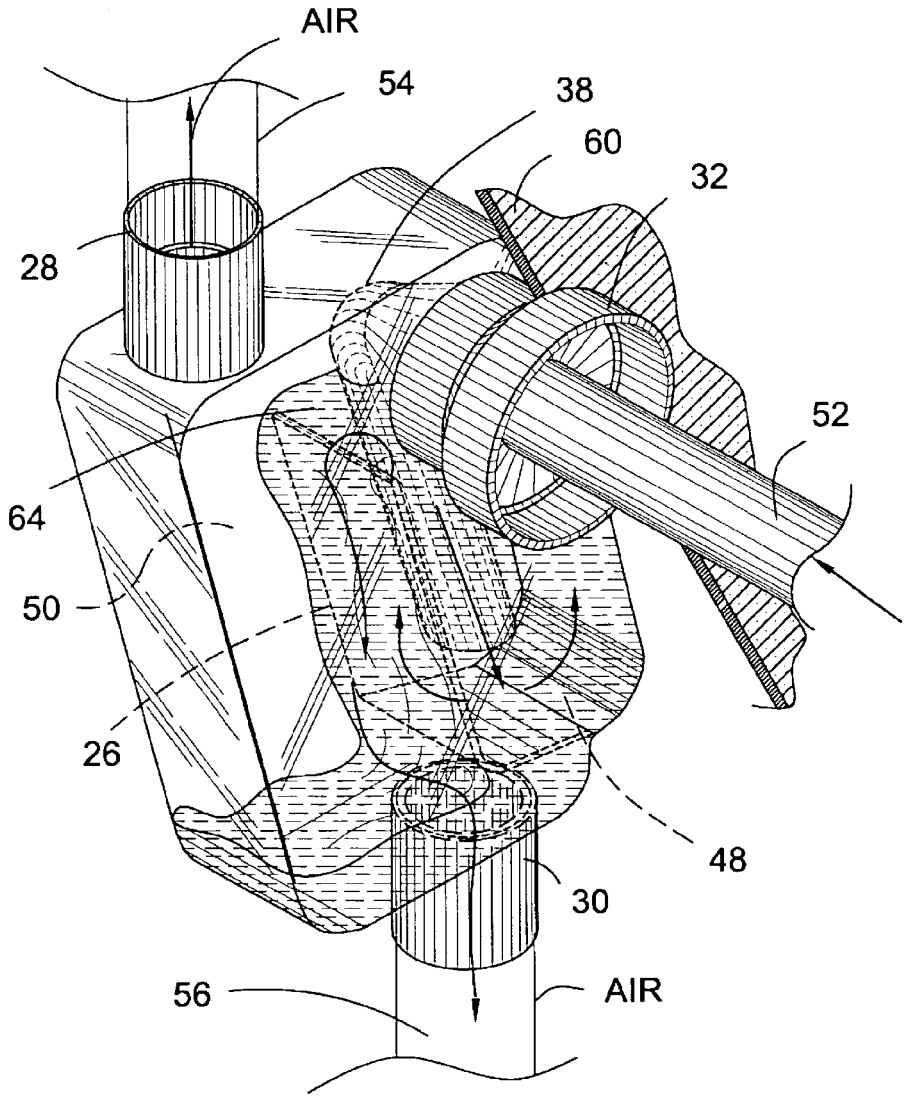
FIG. 9 is an illustrative view of the present invention.

FIG. 9 is an illustrative view of the present invention 10. Shown is waste water 64 flowing from the drain pipe 52 through the flexible insert 38 increasing the volume of waste water 64 within the liquid seal chamber 48, which overflows at the topmost end of the overflow member 26 exiting through the waste line 56.

Figure 10:
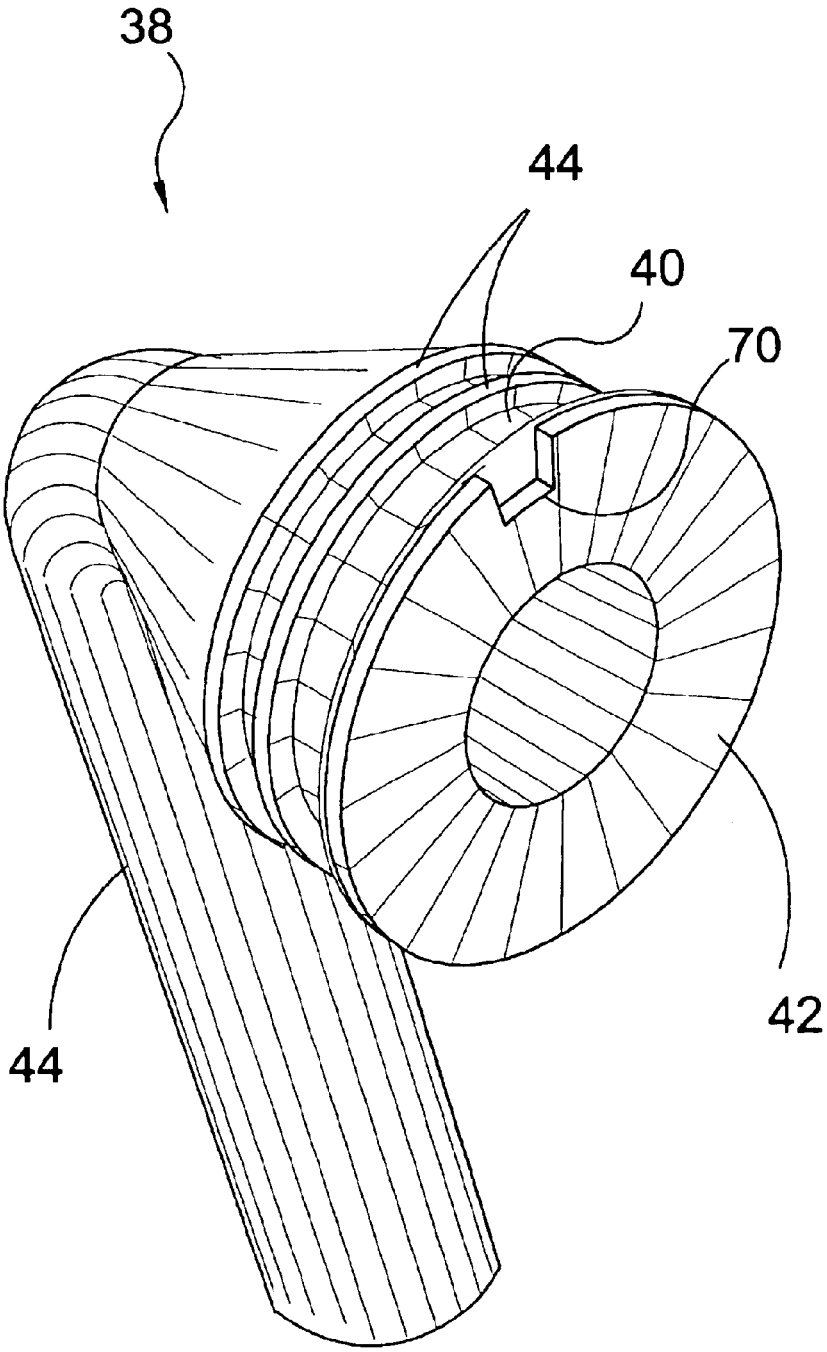
FIG. 10 is a perspective view of the flexible insert of the present invention.

FIG. 10 is a perspective view of the flexible insert 38 of the present invention. Shown is a gasket-like shroud that is inserted into the wall flange assembly 32 to form a seal when the drain pipe 52 is inserted therein. The flexible seal 38 comprises a sealing head 40 that resides within the wall flange assembly 32 and utilizes the sealing face 42 and the sealing flanges 44 to provide a tight seal. The discharge tube 46 extends into the liquid seal chamber. Additionally shown is the female notch 70 used to engage the male key 72 to hold the flexible insert 38 in place.

Figure 11:
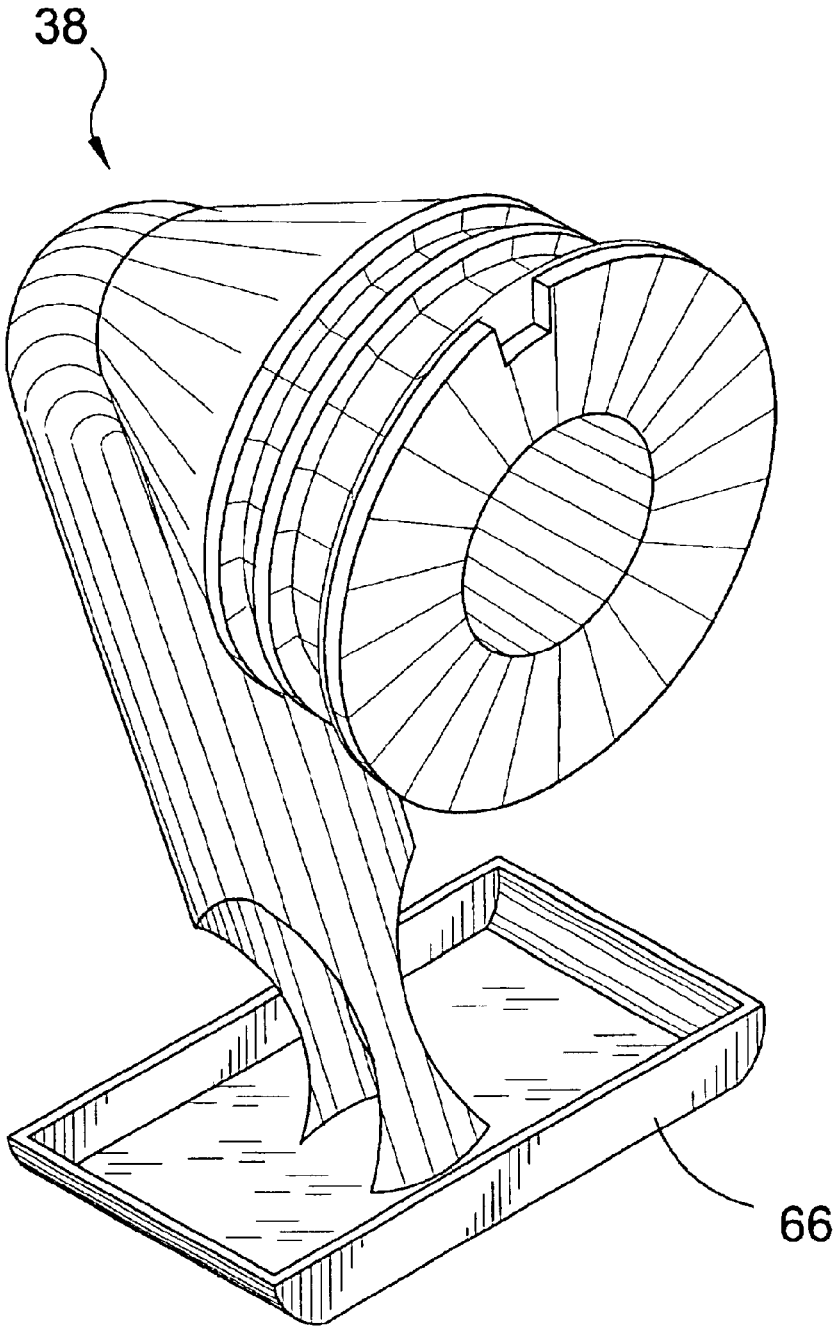
FIG. 11 is a perspective view of the flexible insert of the present invention with a catch basin.

FIG. 11 is a perspective view of the flexible insert 38 of the present invention with a catch basin 66. Shown is an additional element in the form of a catch basket 66 that may be used in conjunction with the gasket like shroud that is inserted into a pipe coupling sealing therein by means of the flexible sealing flange thereon.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An in-the wall plumbing trap with integral waste and vent lines comprising:

a) a housing that is substantially rectangular in cross section having a top plate, a bottom plate, a front plate, a rear plate, a first sidewall, a second sidewall and a substantially hollow interior;

b) an overflow member within said interior of said housing and sealed engagement with said front plate, said rear plate and said second sidewall where it traverses medially therefrom to a central portion of said housing interior and then extends upwards prior to terminating well short of said top plate thereby defining two distinct chambers in communication with one another through the open passage formed between the top edge of said overflow member and said top plate with the chamber defined by said overflow member and said second sidewall being the liquid seal chamber and the chamber defined by said overflow member and said first sidewall being the separation chamber;

c) a cylindrical vent pipe coupling exteriorly disposed on said top plate and extending perpendicularly therefrom having a central cavity to provide passage therethrough from said housing interior;

d) a cylindrical waste line coupling exteriorly disposed on said bottom plate and extending perpendicularly therefrom having a central cavity to provide passage therethrough from said housing interior;

e) a cylindrical wall flange assembly having a body exteriorly disposed on an upper portion of said front plate, offset to a region residing above said liquid seal chamber and extending perpendicularly therefrom having a central cavity forming an inlet pipe opening to provide passage therethrough to said housing interior, the distal end of said body wall flares outward and then forms a cylindrical finishing flange having a greater internal circumference than the internal circumference of said body; and f) a removable flexible insert fabricated of a resilient impermeable material and comprising a cylindrical sealing head with an exterior circumference slightly less the interior circumference of said body of said wall flange assembly, said sealing head having a first end and a second end with said first end having a substantially flat sealing face extending peripherally therefrom with the exterior circumference thereof greater than the interior circumference of said finishing flange, at least one sealing flange extends peripherally from a central portion of said sealing head with an exterior circumference greater than the interior circumference of said body of said wall flange, a discharge tube projects from said second end of said sealing head at a substantially 90 degree angle.

2. An in-the wall plumbing trap with integral waste and vent lines as recited in claim 1, wherein said flexible insert is installed into said wall flange assembly by inserting said discharge tube through said inlet pipe opening and urging said sealing head into said body of said wall flange assembly thereby forcing said sealing flange and said sealing face to deform and conform respectively to the inner circumferences of said body and said finishing flange thereby resulting in an airtight and watertight seal between said flexible insert and said wall flange assembly with the distal end of said discharge tube disposed in a lower region of said liquid seal chamber.

3. An in-the wall plumbing trap with integral waste and vent lines as recited in claim 2 wherein said flexible insert has a female notch made into the said sealing face that engages a male key extending interiorly off of said finishing flange to hold said flexible insert in place.

4. An in-the wall plumbing trap with integral waste and vent lines as recited in claim 1, wherein said vent pipe coupling is disposed above said separation chamber.

5. An in-the wall plumbing trap with integral waste and vent lines as recited in claim 1, wherein said top edge of said overflow member is disposed on a plane inferior to said inlet pipe opening.

6. An in-the wall plumbing trap with integral waste and vent lines as recited in claim 1, wherein said bottom plate is offset from said top plate in the direction of said second sidewall thereby providing a pitch to said first sidewall and said second sidewall relative to said top plate and said bottom plate.

7. An in-the wall plumbing trap with integral waste and vent lines as recited in claim 6, wherein said first sidewall, said second sidewall, the substantially vertical portion of said overflow member and said discharge tube are substantially parallel.

8. An in-the wall plumbing trap with integral waste and vent lines as recited in claim 7, wherein said pitch of said sidewalls, overflow member and discharge tube is substantially 10 degrees off the vertical axis.

9. An in-the wall plumbing trap with integral waste and vent lines as recited in claim 1, wherein said trap is installed by securing said waste line coupling to said waste line, said vent pipe coupling and inserting the stem of a drain pipe into said inlet pipe opening which further compresses said sealing flanges thereby increasing and assuring the integrity of the seal.

10. An in-the wall plumbing trap with integral waste and vent lines as recited in claim 1, wherein said effluent waste water flows through said drain pipe into said flexible insert, down said discharge tube into said liquid seal chamber where the water is retained therein by said overflow member until the water level reaches the top of said overflow member which then acts as a spillway to allow the overflow to fall into said separation chamber and directed into said waste line, any gas contained in the therein escapes through said vent line due to gasses natural tendency to rise thereby avoiding back pressure and siphoning and allowing said waste water to flow smoothly down to said waste line.

11. An in-the wall plumbing trap with integral waste and vent lines as recited in claim 1, wherein said flexible insert further comprises a catch basin integral with the distal end of said discharge tube, said catch basin having a planar base with a peripheral sidewall.

* * * * *